US008943997B2

(12) United States Patent
Whitehurst

(10) Patent No.: US 8,943,997 B2
(45) Date of Patent: Feb. 3, 2015

(54) HOT MELT GLUE APPLICATOR

(75) Inventor: James Steven Whitehurst, Stedman, NC (US)

(73) Assignee: Mann+Hummel Purolator Filters LLC, Fayetteville, NC (US)

( * ) Notice: Subject to any disclaimer, the term of this patent is extended or adjusted under 35 U.S.C. 154(b) by 2058 days.

(21) Appl. No.: 11/954,809

(22) Filed: Dec. 12, 2007

(65) Prior Publication Data

US 2009/0155463 A1 Jun. 18, 2009

(51) Int. Cl.

| | |
|---|---|
| ***B05C 1/06*** | (2006.01) |
| ***B05C 5/00*** | (2006.01) |
| ***B05C 1/08*** | (2006.01) |
| ***B05C 1/00*** | (2006.01) |
| ***B05C 11/10*** | (2006.01) |
| ***B05D 1/28*** | (2006.01) |
| *B05C 1/02* | (2006.01) |
| *B05D 5/10* | (2006.01) |

(52) U.S. Cl.

CPC ..... *B05C 1/0808* (2013.01); *B05C 1/003* (2013.01); *B05C 1/0813* (2013.01); *B05C 11/1021* (2013.01); *B05D 1/28* (2013.01); *B05C 1/02* (2013.01); *B05D 5/10* (2013.01)

USPC ..... 118/256; 427/428.19

(58) Field of Classification Search

USPC ..... 118/110, 111, 112, 244, 246, 255, 258, 118/220, 226

See application file for complete search history.

(56) References Cited

U.S. PATENT DOCUMENTS

| | | | | |
|---|---|---|---|---|
| 2,605,739 | A * | 8/1952 | De Florez | 412/37 |
| 3,797,454 | A * | 3/1974 | Kalikow | 118/247 |
| 3,871,762 | A * | 3/1975 | Van Der Vlasakker | 399/123 |
| 4,019,217 | A * | 4/1977 | Schinke | 15/256.53 |
| 4,846,827 | A * | 7/1989 | Sallee et al. | 604/385.26 |
| 5,250,318 | A * | 10/1993 | Tooker | 427/8 |
| 2004/0134596 | A1 * | 7/2004 | Rosati et al. | 156/230 |
| 2005/0150402 | A1 * | 7/2005 | Kambara | 101/123 |

OTHER PUBLICATIONS

Vortec Website, http://www.vortec.com, Dec. 6, 2006.*
Graphischer Maschinenbau Nordhausen GmbH (GMN) SVK 15-35/350 information, 4 pages, Oct. 11, 2005.

* cited by examiner

*Primary Examiner* — Dah-Wei D Yuan
*Assistant Examiner* — Charles Capozzi
(74) *Attorney, Agent, or Firm* — Crowell & Moring LLP

(57) ABSTRACT

An apparatus for transferring adhesive material to portions of filter elements that are displaced relative to the apparatus includes a dispenser from which heated adhesive material is discharged, a transfer arrangement that receives discharged adhesive material and transfers the discharged adhesive material to the portions of the elements as they are displaced, and a cooling arrangement. The cooling arrangement cooperates with the transfer arrangement to cool the discharged adhesive material while the adhesive material is carried by the transfer arrangement to the adhesive material receiving portions of the elements. A process by which adhesive material is transferred to adhesive material receiving portions of the filter elements, as well as an air line panel filter produced by that process, are also discussed.

20 Claims, 3 Drawing Sheets

HOT MELT GLUE APPLICATOR

BACKGROUND OF THE INVENTION

1. Field of the Invention

This invention concerns an apparatus used during manufacture of air line panel filters or for any customer required panel filter glue applications, as well as to a process of manufacturing such filters.

2. Description of Related Art

One known apparatus for application of glue to filter elements is available from Graphischer Maschinenbau Nordhausen GmbH ("GMN"). During operation of this apparatus, glue is applied to a slick fiberglass belt moving at the same speed as a conveyor. As a filter element comes in contact with the belt, glue is transferred to the top of that element, with glue passing from the GMN glue gun at 400° F. The filter element is held between the belt and the conveyor for 28 inches while the glue cools. As the filter element exits the apparatus, the glue peels away and stays on top of the filter element.

Glue of the sort typically used in filter fabrication separates from the belt at approximately 180° F., when it is no longer tacky. The 28 inches of travel in the known GMN apparatus provides adequate time for the glue to harden so that it does not pull off. Cooling, however, is relatively slow; with a conveyor linear speed of about 15.5 feet per minute, production is limited to approximately 4-5 parts per minute. The length of the filter elements produced can also vary the number of parts processed per minute.

SUMMARY OF THE INVENTION

It is one object of this invention to improve filter element output. This object, and others, may be achieved by way of an apparatus for transferring adhesive material to portions of filter elements that are displaced relative to the apparatus including a dispenser from which heated adhesive material is discharged, a transfer arrangement that receives discharged adhesive material and transfers the discharged adhesive material to the adhesive material receiving portions of the elements that are displaced relative to the apparatus, and a cooling arrangement. The cooling arrangement cooperates with the transfer arrangement to cool the discharged adhesive material while the adhesive material is carried by the transfer arrangement to the adhesive material receiving portions of the elements.

The transfer arrangement preferably includes at least one rotatable wheel adapted to receive the discharged adhesive material on an outwardly facing circumferential surface, and the cooling arrangement preferably includes at least one conduit, such as a conduit within a hollow shaft on which the wheel is mounted, by which cooled compressed air can be supplied to a hollow interior of the wheel. The transfer arrangement can also be adjustable to accommodate elements of various thicknesses, and, instead of one wheel, could include a pair of wheels disposed at a distance from each other that can be changed.

The invention also concerns a process by which adhesive material is transferred to adhesive material receiving portions of the filter elements, as well as an air line panel filter produced by that process.

One difference in outputs of the GMN machine and a machine of the present invention is created by modifying the hardening time of the glue necessary to prevent it from pulling off the filter and sticking to the applicators. Adhesive is evenly applied to tops of the panel filter elements with precise application at a desirable line rate.

In one preferred configuration of this invention, the glue applicator has two wheels that accumulate adhesive from glue guns and reapply even beads to the filter elements without having the elements adhere to the application wheel. This applicator permits a reduction in glue usage by 50%, minimizes scrap preventing the glue from sticking to the filter bag with faster drying, and enhances the ability to apply adhesive at significantly increased rates. Since each wheel is cold, hot melt glue hardens against the wheel, leaving the face side soft and tacky, facilitating transfer to a passing filter element.

The unique design described and illustrated is intended to allow the glue to become more rigid on its surface side but remain soft enough to be applied to the element, resulting in a smooth flat surface on the finished product. One result of this design is an increase in the number of parts processed per minute, preventing the "off-stack" of filters needing to be rescheduled for processing.

BRIEF DESCRIPTION OF THE DRAWINGS

FIG. 2 is a view of the frame shown in FIG. 1 from an element discharge end.

DETAILED DESCRIPTION OF THE INVENTION

Figure 1:
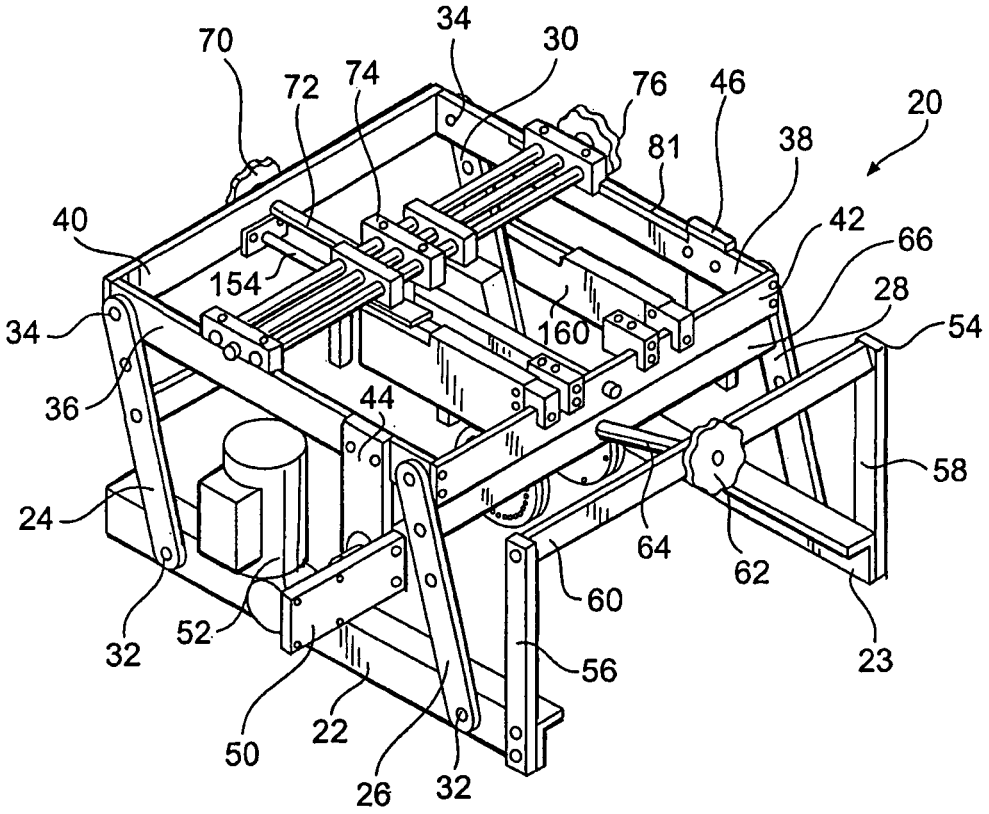
FIG. 1 is a perspective view of a frame of the glue applicator assembly according to the present invention.
Figure 3:
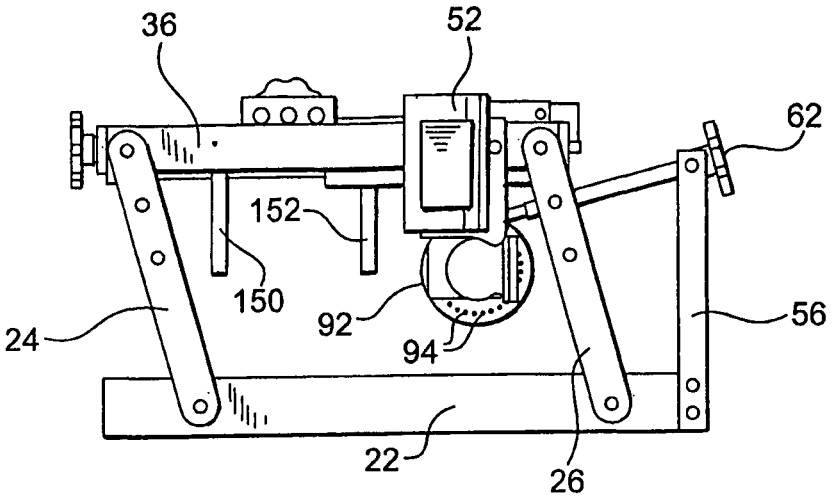
FIG. 3 is a side view of the frame shown in FIG. 1.

FIGS. 1-4 show a first configuration of a frame 20 for the glue applicator assembly, with the glue bead applicator nozzle and certain other elements removed for clarity. The glue applicator frame 20 includes a pair of base elements 22, 23, which, as illustrated in the figures, are formed by angled beams having approximately "L" shaped cross sections. These base elements are configured and dimensioned to fit on and be secured to stationary side rails of a filter transport device having a conveyor belt as will be described. Bolts, screws, or other appropriate connections 32 pivotally attach first ends of left side legs 24, 26 to the left side base element 22. First ends of right side legs 28, 30 are similarly attached to the right side base element 23. In the same way, second ends of the left side legs 24, 26 are pivotally attached by connections 34 to ends of a left side rail 36, while second ends of the right side legs 28, 30 are pivotally attached by connections 34 to a right side rail 38. An upstream end rail 40 interconnects adjacent upstream ends of the left and right side rails 36, 38, while a downstream end rail 42 interconnects adjacent downstream ends of the left and right side rails. The rails 36, 38, 40, and 42 together form a subframe serving to support various elements of the glue applicator assembly as will be described.

Figure 4:
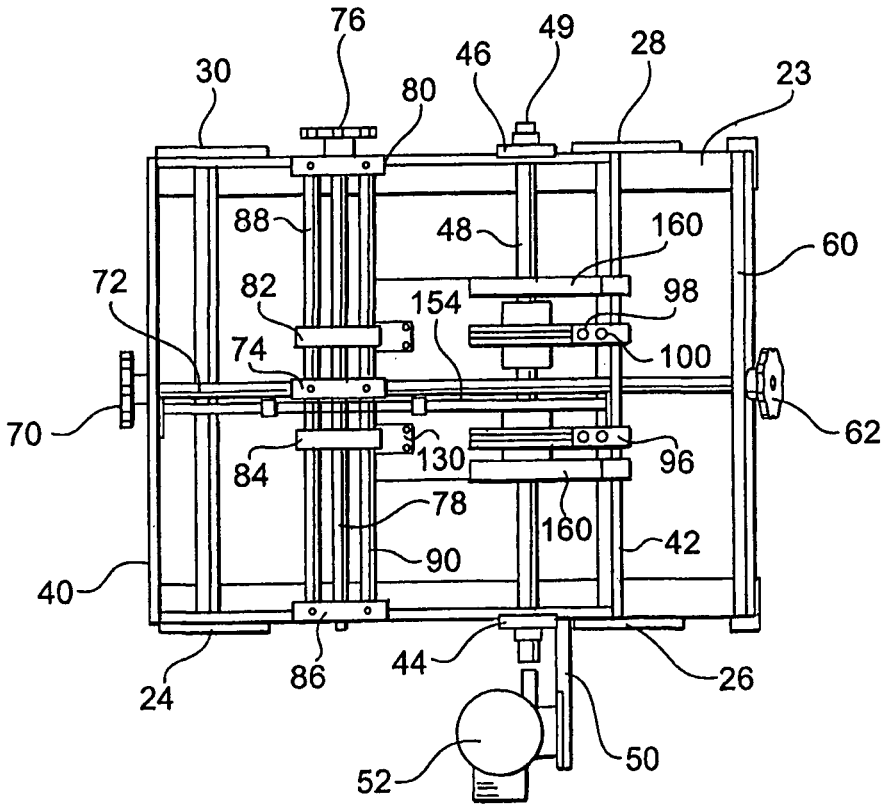
FIG. 4 is a top view of the frame shown in FIG. 1.

Wheel shaft mounting plates 44, 46 are riveted, bolted, or otherwise rigidly secured to each of the left and right side rails 36, 38. The plates 44 and 46 are provided with appropriate ball, roller, or similar bearings within which a hollow cylindrical wheel shaft 48 passes and is mounted for rotation relative to those plates, as is best shown in FIGS. 2 and 4. At least one of the plates 44, 46 has a motor mount 50 formed with or secured to it; as shown in FIGS. 1-4, the motor mount is secured to the left side mounting plate 44. A conventional motor 52, which may be operated electrically, is secured to the motor mount 50, and imparts rotation to the wheel shaft 48 by appropriate gearing.

A stationary bracket 54 is secured near the downstream ends of base elements 22 and 23. The bracket 54 shown includes bracket legs 56, 58 respectively bolted, welded, or otherwise secured to the base elements 22 and 23. A bracket cross rail 60 interconnects upper ends of the bracket legs 56, 58, and a rod 64 having a first rotary handle 62 located at one end is supported by an appropriate bearing on the cross rail 60. Rotation of the handle 62 serves to rotate the rod 64, which is secured in a way permitting rotation at its distal end to a cross rail 66 extending between the legs 26, 28. As illustrated, the cross rail 66 is roughly parallel to both the downstream end rail 42 and the bracket cross rail 60. By rotating the handle 62, appropriate threaded connections between the rod 64 and one or both of the cross rails 60 and 66 produce pivotal movement of the legs 24, 26, 28, and 30 toward and away from the stationary bracket 54. This pivotal movement serves to modify the height of the subframe formed by the left and right side rails 36, 38, the upstream end rail 40, and the downstream end rail 42 with respect to the base elements 22, 23, as well as all elements carried by that subframe, so that filter elements of different thicknesses can be accommodated as will be explained.

A second rotary handle 70 is located at one end of a rod 72 that extends between the upstream end rail 40 and the downstream end rail 42. The rod 72 is connected by threads to a middle carriage block 74, and is supported by appropriate bearings for rotation at the end rails 40 and 42. A third rotary handle 76 is similarly disposed at one end of a rod 78 that extends, from the handle 76, through a first outer carriage block 80, a first inner carriage block 82, the middle carriage block 74, a second inner carriage block 84, and a second outer carriage block 86. Each of rods 64, 72, and 78 is a threaded rod, such as an ACME threaded rod, to provide for movement of parts respectively associated with those rods. Guide rods 88 and 90 extend parallel to the rod 78, and are disposed on opposite sides of that rod 78. The guide rods 88 and 90 both are fixed at first ends to the outer carriage block 80, pass through bores provided in the middle carriage block 74 and in the inner carriage blocks 82, 84, and are fixed again at second ends to the outer carriage block 86.

The carriage block assembly, as a whole, includes the handle 76, the carriage blocks 74, 80, 82, 84, and 86, the rod 78, and guide rods 88 and 90. When the handle 70 is rotated, the threaded connection between the rod 72 and the middle carriage block 74 serves to move this carriage block assembly, as a whole, along the rod 72 in a direction parallel to the base elements 22, 23 and the left and right side rails 36, 38, with the outer carriage blocks 80, 86 sliding along track sections 81 of the side rails 36, 38. In this way, as will become clear, the longitudinal position of a glue dispenser relative to elements of the frame 20 can be modified.

The handle or crank 76 is provided to move glue guns in unison; for this purpose, left and right threads are provided. More particularly, adjustment of the axial distance between the inner carriage blocks 82 and 84 is possible by rotating the third handle 76; the threaded connections between the rod 78 and the inner carriage blocks are configured such that rotation of the handle 76 in one direction, such as clockwise, moves the blocks 82 and 84 apart along the guide rods 88 and 90, while rotation of the handle 76 in the opposite direction moves the blocks towards each other along the guide rods. This movement may be accomplished, for example, by threading the rod 78 along oppositely directed helixes on opposing sides of the middle carriage block 74.

Glue application wheels 92 are positioned in appropriate locations on the wheel shaft 48. Each wheel 92, in the preferred embodiment of this invention, is a six inch diameter aluminum wheel with an outer circumference that turns or rotates at a speed that is the same as a linear speed at which a conveyor, not shown in FIGS. 1-4, moves filters past the glue applicator frame 20. Each of the wheels 92 is used for application of glue to a series of filters passing by the frame 20 on the conveyor, optimally moving at a linear speed of 31.2 feet per minute. As will be described, heated glue is applied to the circumferential faces of the wheels 92. As the filter feeds under the wheel, glue is transferred from those circumferential faces to the filter, optimally at 31.2 feet per minute, yielding roughly 16 parts per minute. An arrangement according to the preferred form of the invention, however, has the ability to increase part output by 5 parts per minute if necessary.

Each aluminum wheel is hollow, and is ventilated. Holes 94 provided between wheel hubs and outside edges of the wheels, for example, can be used to facilitate ventilation. Cooling is produced by way of the cold air forced through the hollow wheel center that escapes through the holes 94. In a preferred form of the invention, cooling can be provided by compressed air and a conventional, commercially available VORTEC device, which receives the compressed air and discharges hot air from its tip and cold air from its bottom. The cold air from the VORTEC device may be supplied by way of a hose and fittings to the interior of the wheel shaft 48 at an end 49 (FIG. 4), so that the air travels through the wheel shaft interior to an appropriate hole, slot, or other such passage or passages and into the hollow interior of each wheel 92, indicated in FIG. 2, as will be described. A swivel coupling, for example, may be used at the end 49 to receive the air blown into the shaft at the opposite end of the shaft from the motor. The VORTEC cooling system permits the applicator wheel to be cooled to and maintained at a consistent temperature. As will be described, each wheel may be a two-part wheel, with a machined in wheel hub wide enough to permit location adjustment of the wheel and still be able to get air through the hollow cylindrical wheel shaft 48 for cooling as will be described.

Mounting blocks 96 are secured by set screws or in any other appropriate way to the downstream end rail 42. The mounting blocks 96 respectively align with circumferences of the glue application wheels 92 as shown in FIG. 4. Each mounting block 96 includes a first orifice 98, through which a cleaning and/or lubricating fluid can be supplied to the circumferential wheel surfaces directly or by way of an appropriate brush, sponge, or other element, and a second orifice 100 for mounting blades adapted to scrape residual glue from the circumferential wheel surfaces.

Figure 5:
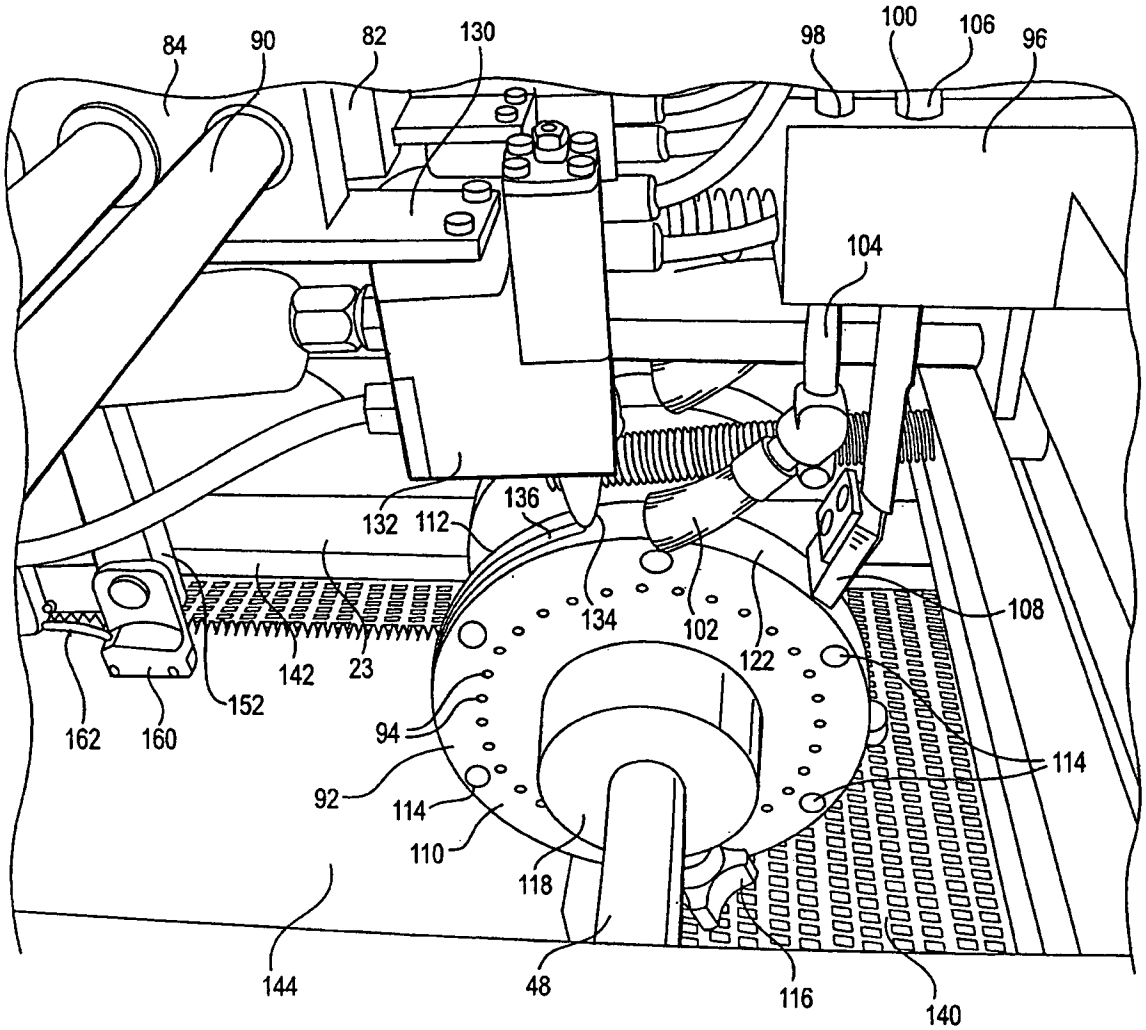
FIG. 5 is an enlarged perspective view of part of the frame shown in FIG. 1, with the glue bead applicator nozzle and other elements of the glue bead applicator apparatus in place.

FIG. 5 provides an enlarged view of a portion of the frame 20, with the glue bead applicator nozzle and other elements of the glue bead applicator apparatus in place, showing one of the mounting blocks 96. The hollow shaft 104 of a brush 102 is received in the first orifice 98, while the shaft 106 of a blade 108 is received in the second orifice 100. As each wheel 92 rotates, cleaning and/or lubricating fluid, such as oil, is supplied to the respective brush 102 through the hollow shaft 104 for application to the adjacent circumferential wheel surface 122, while the respective blade 108 scrapes residual glue from that adjacent circumferential wheel surface. The scraper blade 108 may be nylon or any other appropriate material. As noted, the oiler feeding to the brush 102 is manually moved.

Each glue application wheel 92 is composed of a pair of wheel halves 110, 112, joined together by bolts, rivets, welding, or in other appropriate ways. FIG. 5 shows these wheel halves 110, 112 as joined together by six circumferentially arranged bolts 114. The wheel halves are configured so that, once they are assembled and secured together by the bolts 114, the wheel interior is at least partially hollow, so as to define a central volume or central volumes. Each wheel half also has a hub. As FIG. 5 illustrates, at least one of the hubs of each glue application wheel 92, such as the hub 118 shown, has a set screw 116 to lock or retain that wheel 92 in its proper location along the wheel shaft 48 so that the interior of the wheel 92 is in fluid communication with the interior of the wheel shaft 48 through the hole, slot, or other passage or passages mentioned previously. Cold air supplied in the manner noted above can thus pass through a conduit defined by the interior of the wheel shaft 48, from the wheel shaft interior into the interior of the wheel 92, and then exit from the interior of the wheel 92 through the holes 94 after absorbing heat, thereby cooling the glue receiving wheel surface 122. The hollow wheel shaft 48 thus forms a cooling arrangement cooperating with the wheel to cool the glue on the wheel surface 122.

Each of the inner carriage blocks 82 and 84 has a mounting plate to which a glue dispenser is secured. Each dispenser can thus be aligned with a respective one of the glue receiving wheel surfaces by movement of the carriage blocks. The mounting plate 130 indicated in FIGS. 4 and 5 is attached to or formed together with the carriage block 84 and has a glue dispenser 132 bolted thereto. Glue conventionally used in filter fabrication, heated to approximately 390°-400° F., is fed by way of the dispenser 132 through the nozzle 134 and onto the wheel surface 122 to produce a bead of glue 136.

The base elements 22, 23 of the glue applicator frame 20 are configured and dimensioned to fit on and be secured to stationary side rails 142 of a filter transport device. The filter transport device has a conveyor belt 140 by which filter elements 144 are fed into and past the frame 20, under the glue application wheels 92. The outer circumference of each wheel 92 turns or rotates at a speed that is the same as the linear speed at which the conveyor belt moves the filters past the glue applicator frame 20, and the heated glue, applied to the circumferential faces of the wheels 92, is transferred to the filters as they move past the frame 20. Each wheel thus constitutes a transfer arrangement that receives discharged adhesive material and transfers the discharged adhesive material to appropriate adhesive receiving portions of the filter elements 144. The filter elements are then moved by the conveyor belt away from the frame 20 for further processing and/or assembly. Such further processing would include, for example, securing panel filter tops to the filter elements 144 by way of the glue beads transferred from the wheel surface 122 to the filter elements.

Cooling the surface 122 on which the glue bead is applied causes the glue to harden quickly where it contacts the surface 122. At the same time, the glue becomes tacky in the middle of the bead, while remaining hot and soft in portions of the bead furthest from the surface 122. When applied to the filter elements 144, the invention allows for a quick transfer of glue to the filter and permits a rate of production of 16-21 parts per minute.

Filter elements having various thicknesses can be accommodated by rotating the handle 62, which produces pivotal movement of the legs 24, 26, 28, and 30 toward and away from the bracket 54. As mentioned previously, this pivotal movement serves to modify the height of the subframe formed by the left and right side rails 36, 38, the upstream end rail 40, and the downstream end rail 42 with respect to the base elements 22, 23, as well as all elements carried by that subframe, including the glue application wheels.

Filter elements having various lateral widths can be accommodated by adjusting the distance between the parallel beads of glue applied to those elements. Such an adjustment is performed by changing the positions of wheels 92 on the wheel shaft 48, aligning the mounting blocks 96 with the repositioned wheels by moving those blocks along the downstream end rail 42, and rotating the handle 76 to move the blocks 82 and 84 apart or together along the guide rods 88 and 90 for alignment as well.

Finally, filter elements of any desired length can be accommodated by way of sensors that are preferably incorporated into the glue applicator frame 20. These sensors signal when glue is initially to be pumped or fed through the nozzles 134 and when the flow of glue through the nozzles should be cut off. Such sensors can be secured on mounts, such as rods or bars 150, 152 suspended from an attachment rod 154 secured to the end rails 40 and 42. FIG. 5 illustrates one such sensor 160 secured to the rod or bar 152. Two sensors are preferably provided, with the first sensor turning on glue dispensing and the second sensor terminating glue dispensing when the filter leaves the glue application station. The sensors are programmable according to height.

Leads 162 interconnect the sensors to an appropriate control unit or one of several control units (not shown). Such a control unit(s) is (are) commercially available and readily programmable or operable by those having ordinary skill in the art to perform functions such as initiation and cut off of glue supply, supply and termination of compressed cooling air, initiation and termination of conveyor belt movement, glue heating, operation of the motor 52 to impart rotation to the wheel shaft 48 at an appropriate speed, supply of fluid through the hollow shaft 104, and so on. By way of example only, an appropriate control unit may include a variable transformer device (VARISTAT) to adjust motor speed, an electrical dial, tachometers, and so on.

Protective shields 160 may be mounted on the downstream end rail 42 to minimize chances that a user will contact heated elements during operation of the glue bead applicator apparatus.

The foregoing disclosure has been set forth merely to illustrate the invention and is not intended to be limiting. Since modifications to the disclosed embodiments incorporating the spirit and substance of the invention may occur to persons of ordinary skill in the art, the invention should be construed to include everything within the scope of the appended claims and equivalents thereof.

The invention claimed is:

1. An apparatus by which adhesive material is transferred to adhesive material receiving portions of individual elements that are displaced relative to the apparatus, comprising:

a dispenser from which heated adhesive material is discharged through a dispenser nozzle, a transfer arrangement having an outwardly facing cylindrical surface that receives a bead of adhesive material from the dispenser nozzle, carries the bead of adhesive material, and transfers the adhesive material to the adhesive material receiving portions of the individual elements that are displaced relative to the apparatus, a cooling arrangement cooperating with the transfer arrangement to cool the bead of adhesive material while the adhesive material is carried by the transfer arrangement to the adhesive material receiving portions of the individual elements, a frame having base elements, a stationary bracket secured near adjacent ends of the base elements, and a subframe pivotally interconnected with the base elements and carrying the dispenser and the transfer arrangement, the base elements securable to side rails of a conveyor for displacing the individual elements relative to the apparatus, and an actuation arrangement configured to produce pivotal movement of the subframe relative to the base elements and the stationary bracket to modify the height of the subframe relative to the conveyor and accommodate the individual elements when those individual elements have different thicknesses.

2. The apparatus according to claim 1, wherein the transfer arrangement includes at least one rotatable wheel adapted to receive the discharged adhesive material on the outwardly facing circumferential surface.

3. The apparatus according to claim 2, wherein the cooling arrangement includes at least one conduit by which cooled compressed air can be supplied to the wheel.

4. The apparatus according to claim 3, wherein the at least one conduit supplies the air to a hollow interior of the wheel.

5. The apparatus according to claim 1, wherein the transfer arrangement includes a pair of wheels disposed at a distance from each other that are adapted to receive the discharged adhesive material on outwardly facing circumferential surfaces, and wherein said distance is adjustable.

6. The apparatus according to claim 3, wherein the at least one conduit is defined by a hollow shaft on which the wheel is mounted.

7. The apparatus according to claim 4, wherein the at least one conduit is defined by a hollow shaft on which the wheel is mounted.

8. The apparatus according to claim 1, wherein the cooling arrangement includes at least one conduit by which cooled compressed air can be supplied to the transfer arrangement.

9. The apparatus according to claim 1, wherein the dispenser is one of a pair of dispensers, and wherein a distance between the dispensers is adjustable.

10. The apparatus according to claim 1, wherein the individual elements are air line panel filters.

11. The apparatus according to claim 1, further comprising a blade that scrapes residual adhesive material from the cylindrical surface.

12. The apparatus according to claim 11, further comprising an arrangement by which lubricating fluid is supplied to the cylindrical surface interposed between the blade and a location on the cylindrical surface at which the bead of adhesive material is received.

13. The apparatus according to claim 12, wherein the arrangement includes a brush for applying the lubricating fluid to the cylindrical surface.

14. The apparatus according to claim 13, wherein the dispenser nozzle is one of a pair of dispenser nozzles disposed at an adjustable distance relative to each other, the transfer arrangement includes a pair of rotatable wheels disposed at an adjustable distance relative to each other, the blade is one of a pair of blades disposed at an adjustable distance relative to each other, and the brush is one of a pair of brushes at an adjustable distance relative to each other.

15. The apparatus according to claim 3, further comprising a blade that scrapes residual adhesive material from the cylindrical surface.

16. The apparatus according to claim 15, further comprising an arrangement by which lubricating fluid is supplied to the cylindrical surface interposed between the blade and a location on the cylindrical surface at which the bead of adhesive material is received.

17. The apparatus according to claim 16, wherein the arrangement includes a brush for applying the lubricating fluid to the cylindrical surface.

18. The apparatus according to claim 17, wherein the dispenser nozzle is one of a pair of dispenser nozzles disposed at an adjustable distance relative to each other, the wheel is one of a pair of rotatable wheels disposed at an adjustable distance relative to each other, the blade is one of a pair of blades disposed at an adjustable distance relative to each other, and the brush is one of a pair of brushes at an adjustable distance relative to each other.

19. The apparatus according to claim 1, wherein the subframe and the base elements are pivotally interconnected by multiple side legs.

20. The apparatus according to claim 1, wherein the actuation arrangement includes a rod interconnecting the stationary bracket and the subframe by way of at least one threaded connection.

* * * * *